US009816351B2

(12) United States Patent
Lirette et al.

(10) Patent No.: US 9,816,351 B2
(45) Date of Patent: Nov. 14, 2017

(54) MULTI-STAGE CEMENTING TOOL AND METHOD

(71) Applicant: Antelope Oil Tool & Mfg. Co., LLC, Mineral Wells, TX (US)

(72) Inventors: Brent James Lirette, Cypress, TX (US); Kyle Taylor, Spring, TX (US); Tyler Tinnin, Cypress, TX (US); Michael Lynn Betik, Tomball, TX (US); Chris Lovelady, Tomball, TX (US)

(73) Assignee: ANTELOPE OIL TOOL & MFG. CO., Houston, TX (US)

( * ) Notice: Subject to any disclaimer, the term of this patent is extended or adjusted under 35 U.S.C. 154(b) by 26 days.

(21) Appl. No.: 14/940,707

(22) Filed: Nov. 13, 2015

(65) Prior Publication Data

US 2016/0138367 A1 May 19, 2016

Related U.S. Application Data

(60) Provisional application No. 62/079,829, filed on Nov. 14, 2014.

(51) Int. Cl.
*E21B 33/14* (2006.01)
*E21B 34/14* (2006.01)
(Continued)

(52) U.S. Cl.
CPC ..... *E21B 34/12* (2013.01); *E21B 33/13* (2013.01); *E21B 33/146* (2013.01);
(Continued)

(58) Field of Classification Search
CPC ..... E21B 33/14; E21B 33/146; E21B 34/14; E21B 2034/007
See application file for complete search history.

(56) References Cited

U.S. PATENT DOCUMENTS 3,768,556 A * 10/1973 Baker ..... E21B 33/146 166/154
3,789,926 A * 2/1974 Henley ..... E21B 34/14 166/154

(Continued)

FOREIGN PATENT DOCUMENTS

WO 2013-096100 A1 6/2013

OTHER PUBLICATIONS

Tae Wook Park (Authorized Officer), International Search Report and Written Opinion dated Feb. 17, 2016, PCT Application No. PCT/US2015/060605, filed Nov. 13, 2015, pp. 1-17.

*Primary Examiner* — Catherine Loikith
(74) *Attorney, Agent, or Firm* — MH2 Technology Law Group, LLP

(57) ABSTRACT

A downhole tool, multi-stage cementing tool, and method for cementing. The tool includes a body having a bore axially therethrough and an opening radially therethrough, and a first sleeve positioned in the bore of the body. The first sleeve has an opening radially therethrough that is axially aligned with the opening of the body when the downhole tool is in a first configuration. An inner surface of the first sleeve defines a first seat. The tool also includes a second sleeve positioned in the first sleeve, with the second sleeve being aligned with the opening of the first sleeve and preventing fluid flow therethrough when the tool is in the first configuration. The second sleeve is configured to move axially and engage the first seat of the first sleeve when the tool is in a second configuration, so as to resist relative rotation between the first and second sleeves.

21 Claims, 7 Drawing Sheets

(51) Int. Cl.

| | |
|---|---|
| ***E21B 34/12*** | (2006.01) |
| ***E21B 33/13*** | (2006.01) |
| ***E21B 34/06*** | (2006.01) |
| ***E21B 43/26*** | (2006.01) |
| *E21B 34/00* | (2006.01) |

(52) U.S. Cl.
CPC ..... *E21B 34/063* (2013.01); *E21B 43/26* (2013.01); *E21B 2034/007* (2013.01)

(56) References Cited

U.S. PATENT DOCUMENTS

| | | | | |
|---|---|---|---|---|
| 4,674,569 | A | 6/1987 | Revils et al. | |
| 5,048,611 | A * | 9/1991 | Cochran | E21B 21/103 166/319 |
| 5,348,089 | A | 9/1994 | Brandell et al. | |
| 5,411,095 | A * | 5/1995 | Ehlinger | E21B 34/102 166/154 |
| 8,800,655 | B1 * | 8/2014 | Bailey | E21B 33/146 166/177.4 |
| 2007/0261850 | A1 | 11/2007 | Giroux et al. | |
| 2012/0205121 | A1 | 8/2012 | Porter et al. | |

* cited by examiner

MULTI-STAGE CEMENTING TOOL AND METHOD

CROSS-REFERENCE TO RELATED APPLICATIONS

This application claims priority to U.S. Provisional Patent Application having Ser. No. 62/079,829, filed on Nov. 14, 2014. The entirety of this priority application is incorporated herein by reference.

BACKGROUND

A casing string is typically cemented within a wellbore by pumping cement slurry down, through the casing string and radially-outward from the lower end of the casing string. The cement slurry flows upward within an annulus formed between the casing string the wellbore wall, where it is then allowed to set. When the entire length of the casing string cannot be cemented within the wellbore in this manner, a procedure generally known as "multi-stage cementing" is used.

During multi-stage cementing, the cement slurry is pumped into the annulus between the casing string and the wellbore wall from at least two different locations along the length of the casing string. The first location is typically at the bottom of the casing string, commonly referred to as the first stage cementing position. The second and subsequent (if any) locations or "positions" are between the top and bottom of the casing. One or more additional locations/stages may also be employed.

What is needed is an improved multi-stage cementing tool and methods of use.

SUMMARY

Embodiments of the disclosure may provide a downhole tool including a body having a bore axially therethrough and an opening radially therethrough, and a first sleeve positioned at least partially in the bore of the body. The first sleeve has an opening radially therethrough that is axially aligned with the opening of the body when the downhole tool is in a first configuration. An inner surface of the first sleeve defines a first seat. The tool also includes a second sleeve positioned at least partially in the first sleeve. The second sleeve is aligned with the opening of the first sleeve and prevents fluid flow therethrough when the downhole tool is in the first configuration. The second sleeve is configured to move axially and engage the first seat of the first sleeve when the downhole tool is in a second configuration, so as to resist relative rotation between the first and second sleeves.

Embodiments of the disclosure may also provide a multi-stage cementing tool including a body having an axially-extending bore therethrough and a radially-extending opening in communication with the bore, and a first sleeve positioned in the bore of the body. The first sleeve has a radially-extending opening that is axially aligned with the opening in the body when the cementing tool is in a first configuration. An inner surface of the first sleeve forms first and second seats that are axially-offset from one another. The tool also includes a second sleeve positioned at least partially in the first sleeve and defining a seat. The second sleeve is aligned with the opening in the first sleeve and prevents fluid flow therethrough when the cementing tool is in the first configuration, and the second sleeve is axially-offset from the opening in the first sleeve when the tool is in a second configuration such that a path of fluid communication exists from the bore, through the openings in the first sleeve and the body, to an exterior of the body. The tool further includes a third sleeve positioned in the first sleeve and axially-offset from the second sleeve. The third sleeve is configured to engage the second seat of the first sleeve when the cementing tool is in a third configuration. The tool also includes a guide assembly configured to maintain an impediment received in the seat of the second sleeve in substantial alignment with a central longitudinal axis through the body.

Embodiments of the disclosure further provide a method for cementing a portion of a wellbore. The method includes running a downhole tool into the wellbore in a first configuration. The downhole tool includes a body having a bore axially therethrough and an opening radially therethrough, and a first sleeve positioned at least partially in the bore of the body. The first sleeve has an opening radially therethrough that is aligned with the opening of the body when the downhole tool is in a first configuration. An inner surface of the first sleeve defines a first seat. The tool also includes a second sleeve positioned at least partially in the first sleeve. The second sleeve is axially aligned with the opening of the first sleeve and prevents fluid flow therethrough when the downhole tool is in the first configuration. The second sleeve is configured to move axially and engage the first seat of the first sleeve when the downhole tool is in a second configuration, so as to resist relative rotation between the first and second sleeves. The method also includes pumping a first fluid into the wellbore from a surface location. At least a portion of the first fluid flows through the bore in the body and out a lower end of the body.

The foregoing summary is intended merely to introduce a few of the aspects of the present disclosure, and should not be considered exhaustive, an identification of key elements, or otherwise limiting on the present disclosure.

BRIEF DESCRIPTION OF THE DRAWINGS

The disclosure may best be understood by referring to the following description and accompanying drawings that are used to illustrate aspects of the present embodiments. In the drawings.

DETAILED DESCRIPTION

Figure 1:
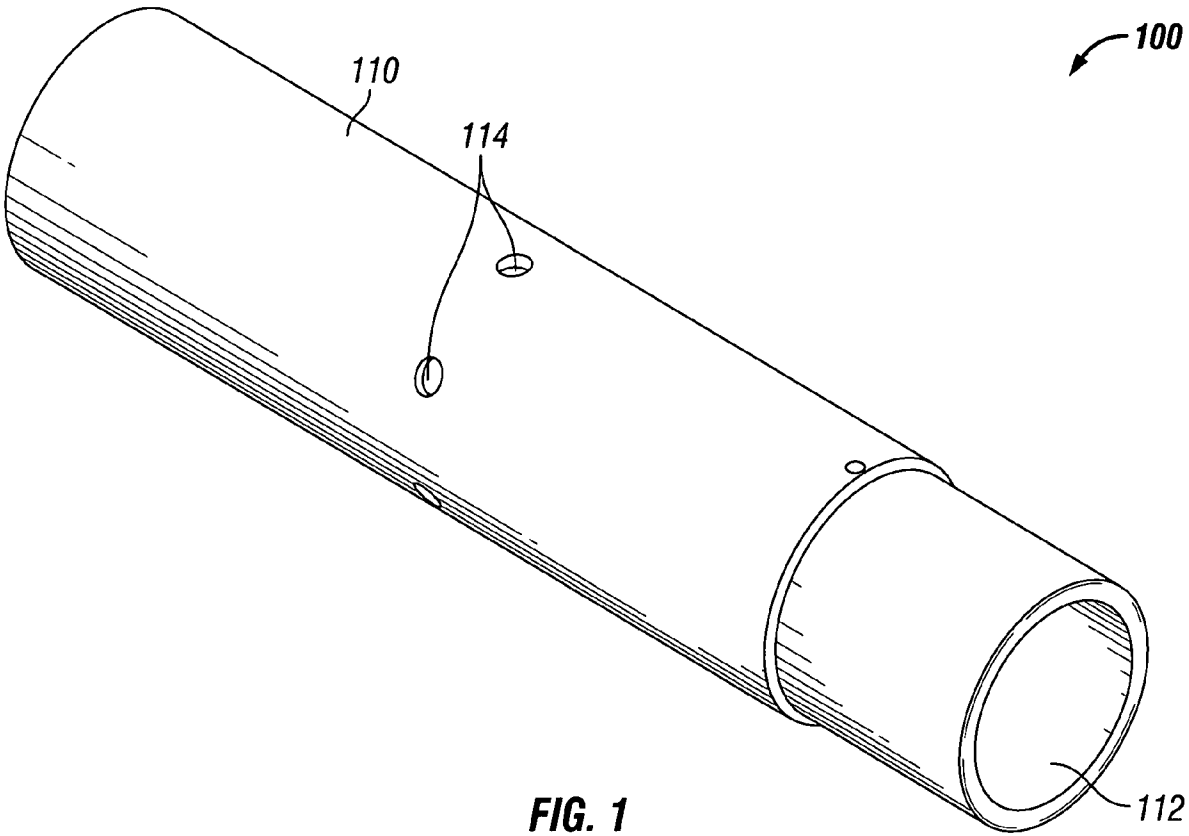
FIG. 1 illustrates a perspective view of a downhole tool, according to an embodiment.

The following disclosure describes several embodiments for implementing different features, structures, or functions of the present disclosure. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, embodiments of the present disclosure may include a downhole tool that includes a plurality of sleeves. At least one of the sleeves may provide a tapered surface, and another of the sleeves may provide a tapered seat. The tapered surface may be configured to engage the tapered seat. This engagement causes the sleeves to wedge together, thereby increasing friction forces between the sleeves during such engagement. This, in turn, causes the sleeves to resist rotation relative to one another. In addition, some embodiments may optionally include a guide assembly configured to prevent misalignment between an impediment (e.g., a plug) and a bore in the downhole tool. The prevention of such misalignment may promote the integrity of the seal between the impediment and the seat that receives the impediment.

Figure 2:
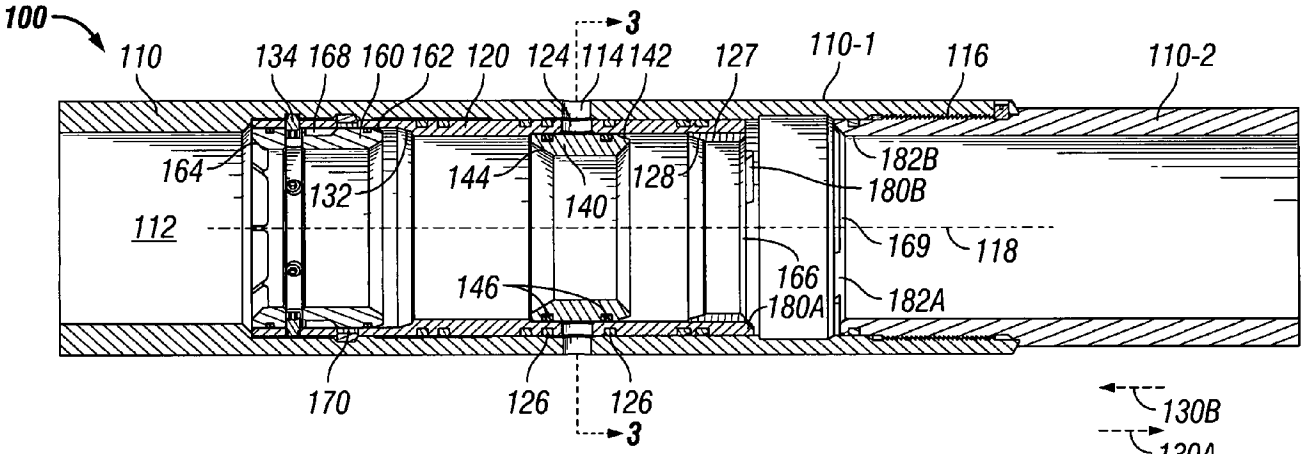
FIG. 2 illustrates a side, cross-sectional view of the downhole tool in a first, run-in configuration, according to an embodiment.

Turning now to the specific, illustrated embodiments, FIGS. 1 and 2 illustrate a perspective view and a side, cross-sectional view of a downhole tool 100, according to an embodiment. In the embodiment shown, the downhole tool 100 is a cementing tool (e.g., a multi-stage cementing tool). However, it will be appreciated that the downhole tool 100 may be any other type of tool that may be attached to a tubular, or string of tubulars, e.g., for use in a wellbore.

The downhole tool 100 may include a tubular body 110. As shown, the body 110 may include two or more portions (two are shown: 110-1, 110-2) that are coupled together. The first portion or "box sub" 110-1 may at least partially overlap or surround the second portion or "pin sub" 110-2, and the portions 110-1, 110-2 may be coupled together via a threaded connection 116.

The body 110 may have an axial bore 112 formed at least partially therethrough. The body 110 may include one or more openings 114 formed radially-therethrough (i.e., through a wall thereof) that provide a path of fluid communication from the bore 112 to the exterior of the body 110. The openings 114 may be circumferentially-offset from one another and/or axially-offset from one another with respect to a central longitudinal axis through the body 110.

One or more sleeves (three are shown: 120, 140, 160) may be positioned in the bore 112 of the body 110 (e.g., in the first portion 110-1 of the body 110). The first or "inner" sleeve 120 may include one or more openings 124 formed radially-therethrough. The openings 124 may be circumferentially-offset from one another and/or axially-offset from one another with respect to a central longitudinal axis 118 through the first sleeve 120 and/or the body 110. The openings 124 in the first sleeve 120 may be axially aligned with the openings 114 in the body 110 when the downhole tool 100 is in the first, run-in configuration, as shown in FIG. 2. This may provide a path of fluid communication from the bore 112, through the openings 114, 124, and to the exterior of the body 110.

One or more seals 126 may be positioned radially between the first sleeve 120 and the body 110. At least one of the seals 126 may be positioned on a first axial side of the openings 124 in the first sleeve 120, and at least one of the seals 126 may be positioned on a second axial side of the openings 124 in the first sleeve 120. The seals 126 may prevent fluid from flowing or leaking axially through the annular space between the first sleeve 120 and the body 110. The seals 126 may be made of a polymer or elastomer (e.g., rubber). For example, the seals 126 may be or include O-rings.

A radially-inwardly extending portion 127 of the first sleeve 120 may define a first seat 128. In an embodiment, the portion 127 of the first sleeve 120 providing the first seat 128 may be a separate sleeve received in and connected to the first sleeve 120. In another embodiment, the portion 127 may be integral with the remainder of the first sleeve 120. Further, the first seat 128 may be positioned proximate to a lower or "downstream" end of the first sleeve 120.

The first seat 128 may be tapered. More particularly, the radial thickness of the first sleeve 120 may increase, as proceeding in a first (e.g., downward or downstream) direction 130A (to the right in FIG. 2), so as to form the first seat 128. In at least one embodiment, the surface of the first seat 128 may be oriented at an angle with respect to the central longitudinal axis 118 through the first sleeve 120 and/or the body 110. The angle may be from about 1° to about 89°, about 5° to about 20°, about 20° to about 35°, about 35° to about 50°, about 50° to about 65°, or about 65° to about 80°. In another embodiment, rather than being planar and oriented at the angle described above, the first seat 128 may be curved.

Another portion of the inner surface of the first sleeve 120 may define a second seat 132. The second seat 132 may be positioned above or upstream from the first seat 128, such that the first and second seats 128, 132 are spaced apart along the axis 118 (i.e., axially offset). As with the first seat 128, the second seat 132 may be tapered, and the radial thickness of the first sleeve 120 may increase, as proceeding in the first direction 130A, so as to form the second seat 132. However, the second seat 132 may have a greater diameter than the first seat 128. In at least one embodiment, the surface of the second seat 132 may be oriented at an angle with respect to the central longitudinal axis 118 through the first sleeve 120 and/or the body 110. The angle may be from about 1° to about 89°, about 5° to about 20°, about 20° to about 35°, about 35° to about 50°, about 50° to about 65°, or about 65° to about 80°. In another embodiment, rather than being planar and oriented at the angle described above, the second seat 132 may be curved.

The first sleeve 120 may be coupled to the body 110 by one or more shear mechanisms 134 and/or lock ring segments 170. The shear mechanisms 134 may be or include pins, screws, bolts, or the like that are designed to break when exposed to a predetermined axial and/or rotational force. The lock ring segments 170 may be released by applying a force to the third sleeve 160 that shears the shear mechanisms 134 between the first sleeve 120 and the third sleeve 160. This forces the third sleeve 160 to move downward and allows the lock ring segments 170 to retract. The first sleeve 120 may be configured to move within the body 110 when the shear mechanisms 134 break, as discussed in greater detail below. In another embodiment, the first sleeve 120 may be held in place in the body 110 with one or more springs.

The second or "closing" sleeve 140 may be positioned at least partially (e.g., radially) within the first sleeve 120, e.g., in the bore 112. The second sleeve 140 may be axially-aligned with the openings 124 in the first sleeve 120 when the downhole tool 100 is in the run-in configuration, as shown in FIG. 2. When aligned with the openings 124, the second sleeve 140 may block or obstruct the path of fluid communication between the bore 112 and the exterior of the body 110.

One or more seals 146 may be positioned radially between the first sleeve 120 and the second sleeve 140. At least one of the seals 146 may be positioned on a first axial side of the openings 124 in the first sleeve 120, and at least one of the seals 146 may be positioned on a second axial side of the openings 124 in the first sleeve 120. The seals 146 may prevent fluid from flowing or leaking axially through the annular space between the first sleeve 120 and the second sleeve 140. The seals 146 may be made of a polymer or elastomer (e.g., rubber). For example, the seals 146 may be or include O-rings.

The second sleeve 140 may include a nose surface 142 that is tapered. The nose surface 142 may be an outer surface and/or a lower surface of the second sleeve 140. The diameter defined by the nose surface 142 of the second sleeve 140 may decrease moving in the first direction 130A, thereby forming a gap radially between the nose surface 142 and the first sleeve 120, with the gap expanding as proceeding in the first direction 130A. At the same axial location, the inner diameter of the second sleeve 140 may decrease, also as proceeding in the first direction 130A, resulting in converging inner and outer diameters at an end of the second sleeve 140. In at least one embodiment, the nose surface 142 of the second sleeve 140 may be oriented at substantially the same angle as the first seat 128 of the first sleeve 120 so that the nose surface 142 of the second sleeve 140 may be received within the first seat 128 of the first sleeve 120, as discussed in more detail below. The angle may be from about 1° to about 89°, about 5° to about 20°, about 20° to about 35°, about 35° to about 50°, about 50° to about 65°, or about 65° to about 80°. In another embodiment, rather than being planar and oriented at the angle described above, the nose surface 142 of the second sleeve 140 may be curved.

The second sleeve 140 may include a seat 144 that is tapered. The seat 144 may be an inner surface and/or an upper surface. The radial thickness of the second sleeve 140 may increase moving in the first direction 130A, so as to form the seat 144. In at least one embodiment, the seat 144 of the second sleeve 140 may be oriented at an angle with respect to the central longitudinal axis 118 through the second sleeve 140 and/or the body 110. The angle may be from about 1° to about 89°, about 5° to about 20°, about 20° to about 35°, about 35° to about 50°, about 50° to about 65°, or about 65° to about 80°. In another embodiment, rather than being planar and oriented at the angle described above, the seat 144 of the second sleeve 140 may be curved.

The third or "opening" sleeve 160 may be positioned at least partially (e.g., radially) within the first sleeve 120. The third sleeve 160 may be axially-offset from the second sleeve 140. As shown, the third sleeve 160 is above/upstream from the second sleeve 140. The third sleeve 160 may include a nose surface 162 that is tapered. The nose surface 162 may be an outer surface and/or a lower surface. The diameter defined by the nose surface 162 of the third sleeve 160 may decrease, as proceeding in the first direction 130A, resulting in a gap radially between the nose surface 162 and the first sleeve 120. At the same axial location, the inner diameter of the third sleeve 160 may decrease, resulting in converging inner and outer diameters at an end of the third sleeve 160. In at least one embodiment, the nose surface 162 of the third sleeve 160 may be oriented at substantially the same angle as the second seat 132 of the first sleeve 120 so that the nose surface 162 of the third sleeve 160 may be received within the second seat 132 of the first sleeve 120, as discussed in more detail below. The angle may be from about 1° to about 89°, about 5° to about 20°, about 20° to about 35°, about 35° to about 50°, about 50° to about 65°, or about 65° to about 80°. In another embodiment, rather than being planar and oriented at the angle described above, the nose surface 162 of the third sleeve 160 may be curved.

The third sleeve 160 may include a seat 164 that is tapered. The seat 164 may be an inner surface and/or an upper surface. The cross-sectional length (e.g., diameter) of the seat 164 of the third sleeve 160 may decrease moving in the first direction 130A. In at least one embodiment, the seat 164 of the third sleeve 160 may be oriented at an angle with respect to the central longitudinal axis 118 through the third sleeve 160 and/or the body 110. The angle may be from about 1° to about 89°, about 5° to about 20°, about 20° to about 35°, about 35° to about 50°, about 50° to about 65°, or about 65° to about 80°. In another embodiment, rather than being planar and oriented at the angle described above, the seat 164 of the third sleeve 160 may be curved.

The outer (e.g., radial) surface of the third sleeve 160 may include a recess 168. The lock ring segments 170 may be coupled to and/or configured to move with the first sleeve 120. The recess 168 in the third sleeve 160 may be axially-offset from (e.g., above or upstream from) the lock ring segments 170 when the downhole tool 100 is in the first, run-in configuration. As discussed in greater detail below, the lock ring segments 170 may become positioned at least partially in the recess 168 in the third sleeve 160 when the third sleeve 160 moves with respect to the first sleeve 120 and/or the body 110.

The third sleeve 160 may be coupled to the first sleeve 120 and/or the body 110 by one or more shear mechanisms 134. As shown, the shear mechanisms 134 may be the same as those coupling the first sleeve 120 to the body 110. In another embodiment, a different set of shear mechanisms may be used. The third sleeve 160 may be configured to move within the first sleeve 120 and/or the body 110 when the shear mechanisms 134 break, as discussed in greater detail below. In another embodiment, the third sleeve 160 may be held in place in the first sleeve 120 with one or more springs.

The first sleeve 120 may also include a lower engaging surface 166, and the pin sub 110-2 may include an upper engaging surface 169. The lower and upper engaging surfaces 166, 169 may be forced toward one another and prevented from rotation through engagement therebetween. For example, the first sleeve 120 includes one or more anti-rotation teeth (two are visible in this cross-section: 180A, 180B) extending axially in the first direction 130A from the lower engaging surface 166. The pin sub 110-2 may also include one or more anti-rotation teeth (two are visible in this cross-section: 182A, 182B) extending in a second direction 130B, opposite to the first direction 130A from the upper engaging surface 169. The teeth 180A, 180B of the first sleeve 120 may be angularly offset from the teeth 182A, 182B of the pin sub 110-2. Further, when the first sleeve 120 is moved in the first direction 130A, toward the pin sub 110-2, the teeth 180A, 180B may engage the upper engaging surface 169, and the teeth 182A, 182B may engage the lower engaging surface 166. The magnitude of the axial force and the tapered geometry of the teeth 180A, 180B and the upper engaging surface 169 may cause interference to be generated therebetween, providing a tight, rotation-preventing engagement therebetween. The teeth 182A, 182B and the lower engaging surface 166 may act similarly.

In other embodiments, at least one of the sets of teeth 180A, 180B or 182A, 182B may be omitted. Further, in some embodiments, an annular tapered surface extending from either (or both) of the first sleeve 120 and the pin sub 110-2 may be provided and may be capable of providing such interference therebetween under axial loading. In such an embodiment, one or more slots or grooves may be provided to facilitate deflection, and thus potentially the generation of hoop stress in the opposing structure, so as to increase friction and enhance rotation resistance. Moreover, it will be appreciated that any number of teeth 180A, 180B, 182A, 182B may be employed in either set.

Figure 3:
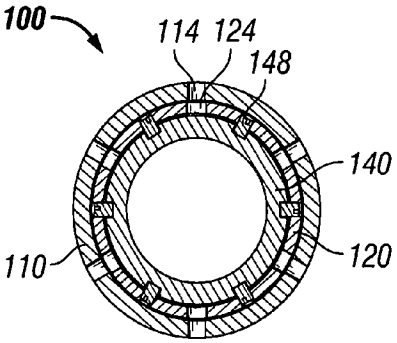
FIG. 3 illustrates a cross-sectional view of the downhole tool taken through line 3-3 in FIG. 2, according to an embodiment.

FIG. 3 illustrates a cross-sectional view of the downhole tool 100 taken through line 3-3 in FIG. 2, according to an embodiment. The second sleeve 140 may be coupled to the first sleeve 120 by one or more shear mechanisms 148, which may be similar to those described above. As shown, the shear mechanisms 148 may be circumferentially-offset from the openings 124 in the first sleeve 120. The second sleeve 140 may be configured to move within the first sleeve 120 and/or the body 110 when the shear mechanisms 148 break, as discussed in greater detail below. In another embodiment, the second sleeve 140 may be held in place with one or more springs.

Figure 4:
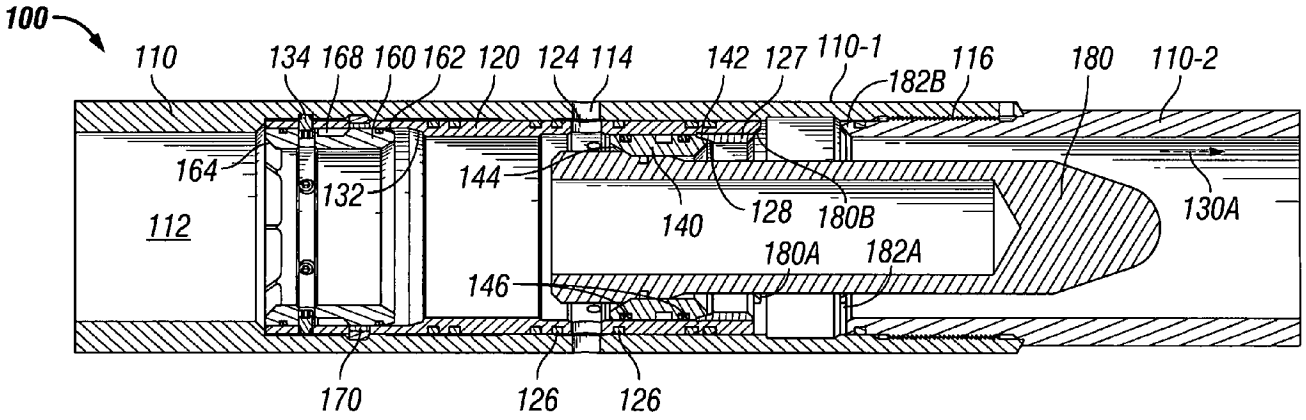
FIG. 4 illustrates a side, cross-sectional view of the downhole tool in a second, open position, according to an embodiment.

FIG. 4 illustrates a side, cross-sectional view of the downhole tool 100 in a second, open position, according to an embodiment. When the downhole tool 100 actuates into the second, open position, the second sleeve 140 may move within the first sleeve 120 and/or body 110 until the nose surface 142 of the second sleeve 140 contacts and comes to rest in the first seat 128 of the first sleeve 120. When this occurs, the second sleeve 140 is no longer axially-aligned with and obstructing the openings 124 in the first sleeve 120. As such, the path of fluid communication from the bore 112, through the openings 114, 124, to the exterior of the body 110 is reestablished.

The engagement between the nose surface 142 of the second sleeve 140 and the first seat 128 of the first sleeve 120 may create a frictional engagement that reduces or prevents relative rotation between the first and second sleeves 120, 140. In at least one embodiment, the nose surface 142 and/or the first seat 128 may have a textured surface to facilitate the frictional engagement. For example, the nose surface 142 and/or the first seat 128 may have bumps, ridges, or the like. In a particular example, one of the nose surface 142 and the first seat 128 may have male protrusions, and the other of the nose surface 142 and the first seat 128 may have female recesses configured to receive the male protrusions. In another embodiment, the nose surface 142 may form a press fit or interference fit with the first seat 128 to facilitate the frictional engagement. In yet another embodiment, one of the nose surface 142 and the first seat 128 may be made of a harder material than the other of the nose surface 142 and the first seat 128 to facilitate the frictional engagement.

Figure 5:
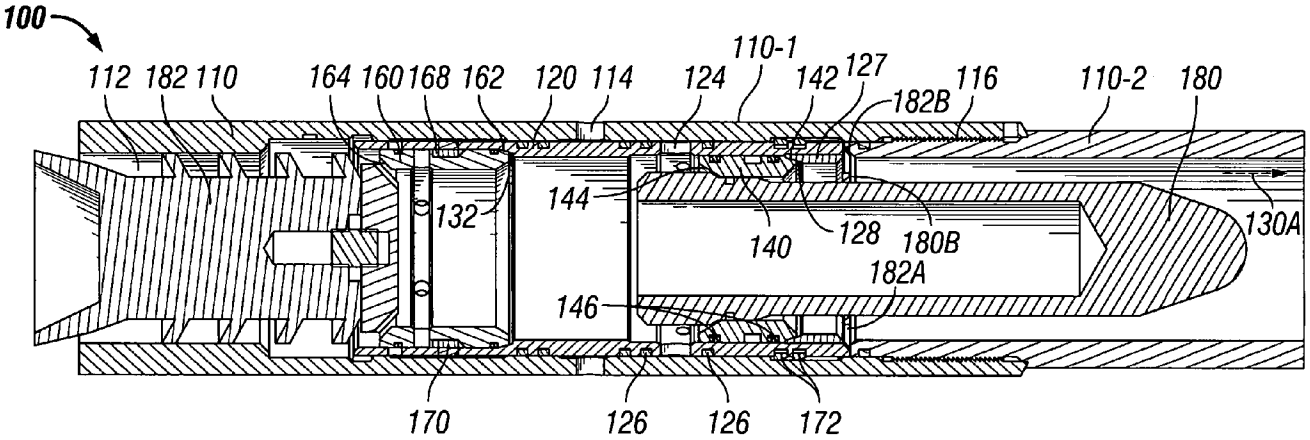
FIG. 5 illustrates a side, cross-sectional view of the downhole tool in a third, closed configuration, according to an embodiment.

FIG. 5 illustrates a side, cross-sectional view of the downhole tool 100 in a third, closed configuration, according to an embodiment. When the downhole tool 100 actuates into the third, closed configuration, the third sleeve 160 may move within the first sleeve 120 and/or body 110 until the nose surface 162 of the third sleeve 160 contacts and comes to rest in the second seat 132 of the first sleeve 120.

The engagement between the nose surface 162 of the third sleeve 160 and the second seat 132 of the first sleeve 120 may create a frictional engagement that reduces or prevents relative rotation between the first and third sleeves 120, 160. In at least one embodiment, the nose surface 162 and/or the second seat 132 may have a textured surface to facilitate the frictional engagement. For example, the nose surface 162 and/or the second seat 132 may have bumps, ridges, or the like. In a particular example, one of the nose surface 162 and the second seat 132 may have male protrusions, and the other of the nose surface 162 and the second seat 132 may have female recesses configured to receive the male protrusions. In another embodiment, the nose surface 162 may form a press fit or interference fit with the second seat 132 to facilitate the frictional engagement. In yet another embodiment, one of the nose surface 162 and the second seat 132 may be made of a harder material than the other of the nose surface 162 and the second seat 132 to facilitate the frictional engagement.

As the third sleeve 160 moves, the lock ring segments 170 may become positioned at least partially within the recess 168 in the outer surface of the third sleeve 160. This may cause the first sleeve 120 to move in the first direction 130A until the openings 124 in the first sleeve 120 are axially-offset from the openings 114 in the body 110. As such, the first sleeve 120 may prevent fluid flow from the bore 112, through the openings 114 in the body 110, and to the exterior of the body 110. One or more lock ring segments 172 may prevent the first sleeve 120 from sliding back into its original position (e.g., in the upstream direction).

Further, in the third, closed configuration, the first sleeve 120 may have been moved in the first direction 130A, such that it is forced into engagement with the pin sub 110-2. This engagement, under an axial load, creates a friction force that resists rotation between the first sleeve 120 and the body 110 (e.g., as between teeth 180A, 180B, 182A, 182B in FIG. 2). Since the second and third sleeves 140, 160 are prevented from rotating relative to the first sleeve 120, the second and third sleeves 140, 160 may thus also be prevented from rotating relative to the body 110. Accordingly, during drill out procedures, the stationary sleeves 120, 140, 160 may resist rotating with the drill bit, thereby facilitating the removal of the sleeves 120, 140, 160.

Figure 6:
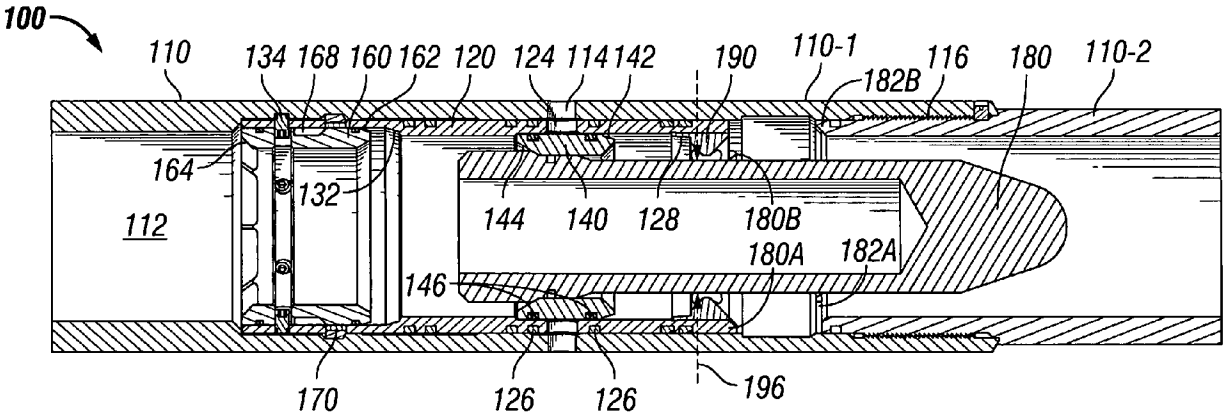
FIG. 6 illustrates a side, cross-sectional view of the downhole tool in the first, run-in configuration while showing a guide assembly for directing an impediment, according to an embodiment.
Figure 7:
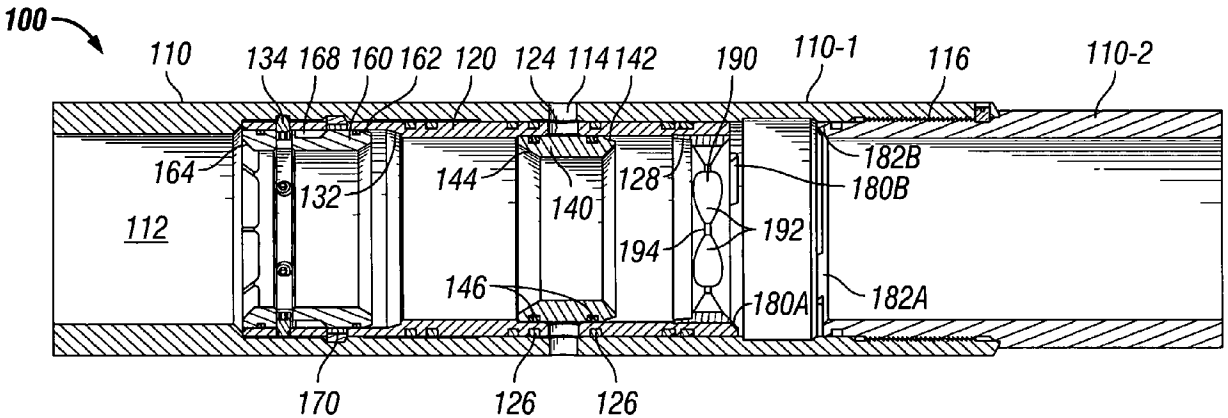
FIG. 7 illustrates another side, cross-sectional view of the downhole tool, similar to the depiction in FIG. 6, but with the impediment omitted for clarity, according to an embodiment.

FIG. 6 illustrates a side, cross-sectional view of the downhole tool 100 in the first, run-in configuration while showing a guide assembly 190 for directing the first impediment 180, and FIG. 7 illustrates the same image with the first impediment 180 omitted for clarity, according to an embodiment. The guide assembly 190 may be coupled to or integral with the first sleeve 120. In another embodiment, the guide assembly 190 may be coupled to or integral with the body 110 or the second sleeve 140.

The guide assembly 190 may be or include one or more protrusions 192 that extend radially-inward from the first sleeve 120 (or the body 110 or the second sleeve 140). In at least one embodiment, the guide assembly 190 may include a single protrusion 192 that extends 360° around the central longitudinal axis 118 through the body 110. An inner diameter 196 of the protrusion 192 may be equal to or slightly greater than the outer diameter of the first impediment 180 such that the guide assembly 190 may maintain the first impediment 180 in alignment in the bore 112. As shown, the guide assembly 190 may include the first seat 128 of the first sleeve 120. However, in other embodiments, the first seat 128 may be separate from the guide assembly 190.

Figure 8:
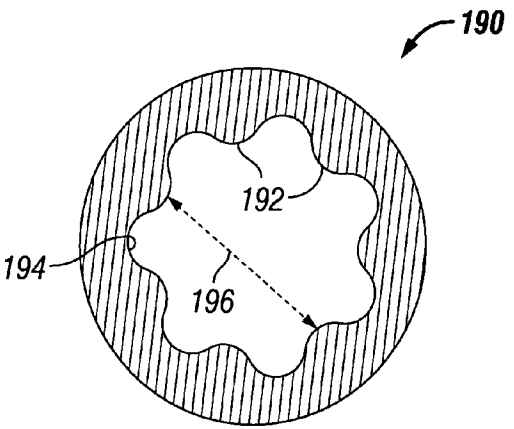
FIG. 8 illustrates an axial end view of the guide assembly, according to an embodiment.

FIG. 8 illustrates an axial end view of the guide assembly 190, according to an embodiment. The guide assembly 190 may be made from a metal or a composite material. In an embodiment, the guide assembly 190 may include a plurality of protrusions 192 that are circumferentially-offset from one another. A recess 194 may be formed between two circumferentially-adjacent protrusions 192. The surface of the recess 194 may have a greater inner diameter than the protrusions 192. For example, the inner surface of the guide assembly 190 may have a scalloped shape.

The guide assembly 190 may limit the eccentricity of the first impediment 180 with respect to the central axis 118. For example, without the guide assembly 190, the first impediment 180 may become misaligned with respect to the central axis 118, and thus a portion of the first impediment 180 may slide away from the seat 144, and may thus fail to create a seal with the seat 144. With the addition of the guide assembly 190, in an embodiment, the first impediment 180 may engage the protrusions 192, such that the protrusions 192 limit the range of misalignment for the first impediment 180. In configurations in which the first impediment 180 is aligned with the central axis 118, the protrusions 192 may be spaced radially-apart from the first impediment 180, such that the first impediment 180 may be received through the guide assembly 190 when deployed.

Figure 9:
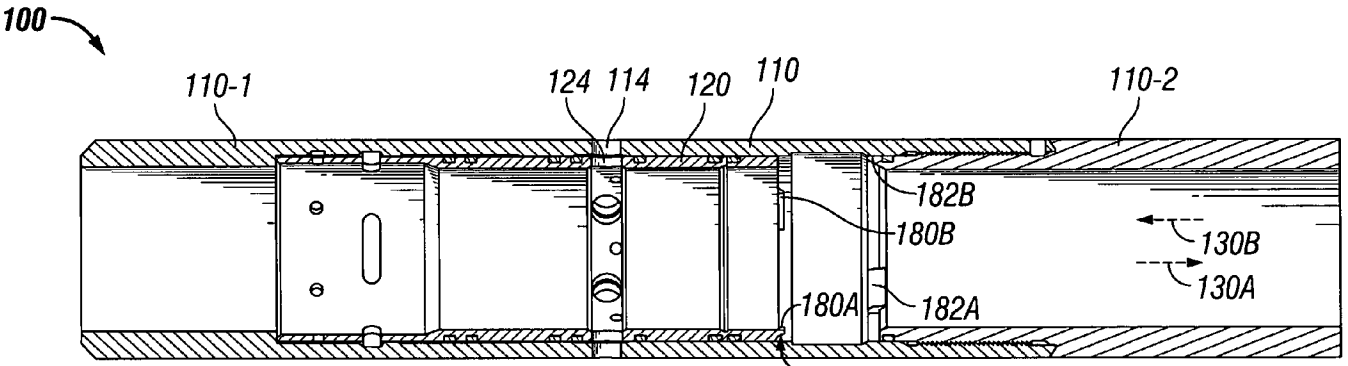
FIGS. 9, 10, and 11 illustrate side, cross-sectional views of another embodiment of the downhole tool, according to an embodiment.

FIG. 9 illustrates a side, cross-sectional view of another embodiment of the downhole tool 100. The downhole tool 100 of FIG. 9 may include the body 110, e.g., the box and pin subs 110-1, 110-2, which may be connected together via engaging threads. Further, the downhole tool 100 may include the first or "inner" sleeve 120. The downhole tool 100 may also include the second and third sleeves 140, 160, although these sleeves 140, 160 are omitted from FIG. 9 for ease of illustration.

In FIG. 9, the downhole tool 100 is shown in the first or second configurations, i.e., with the openings 114, 124 aligned. In this position, the first sleeve 120 is separated axially apart from the pin sub 110-2. In particular, the teeth 180A, 180B of the first sleeve 120 are separated axially apart from the teeth 182A, 182B of the pin sub 110-2.

The teeth 182A, 182B may be tapered, having an increasing radial thickness as proceeding in the first axial direction 130A. The teeth 180A, 180B may be undercut, defining a gap 900 radially between the teeth 180A, 180B and the body 110, with the gap 900 decreasing in radial dimension as proceeding in the second direction 130B. The teeth 182A, 182B may be sized and configured to fit within the gap 900 when the teeth 182A, 182B are angularly aligned with the teeth 180A, 180B.

Figure 10:
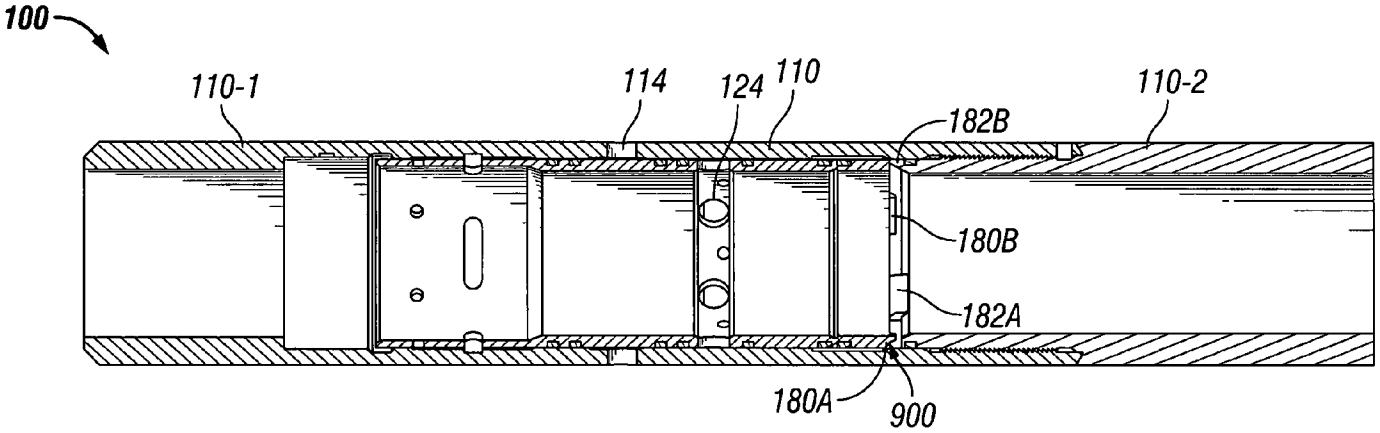
Figure 11:
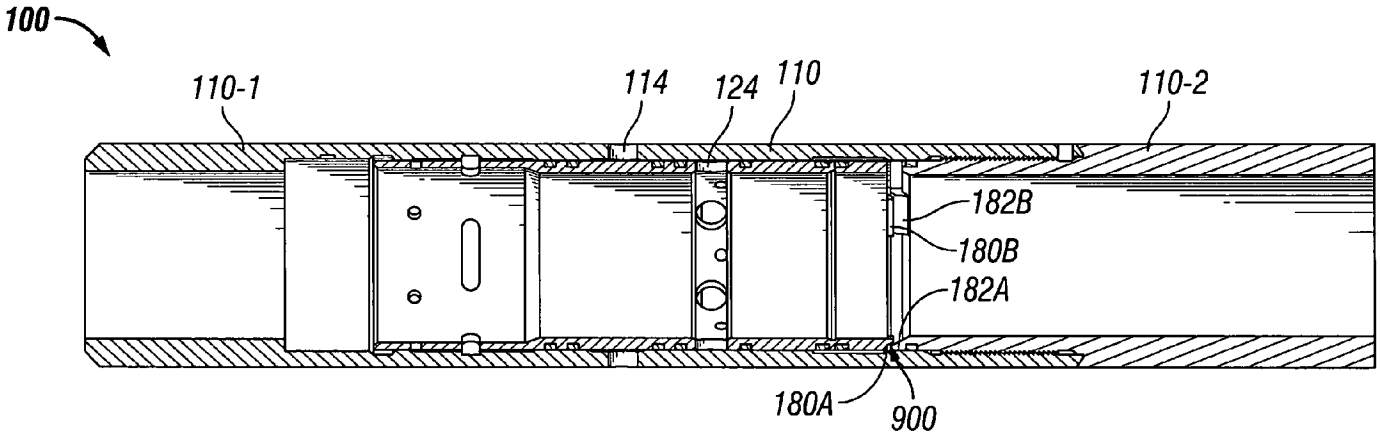

If the teeth 180A, 180B are initially angularly offset from the teeth 182A, 182B, prior to the first sleeve 120 moving into the third, closed configuration, as shown in FIG. 10, when the first sleeve 120 in the first direction 130A, the teeth 180A, 180B, 182A, 182B may not engage one another. As such, the first sleeve 120 may not be prevented from angular rotation relative pin sub 110-2, at least initially. However, during drill-out, the first sleeve 120 may be caused to rotate relative to the pin sub 110-2, until the teeth 180A, 180B are rotated into engagement with the teeth 182A, 182B, as shown in FIG. 11. At such point, the interference between the teeth 180A, 180B, 182A, 182B may be established and may serve to prevent rotation of the first sleeve 120 relative to the body 110. On the other hand, if the teeth 180A, 180B are aligned with the teeth 182A, 182B prior to the first sleeve 120 moving, movement of the first sleeve 120 may result in the overlapping of the teeth 180A, 180B with the teeth 182A, 182B, thereby causing the interference and rotating-resisting friction forces therebetween.

Figure 12:
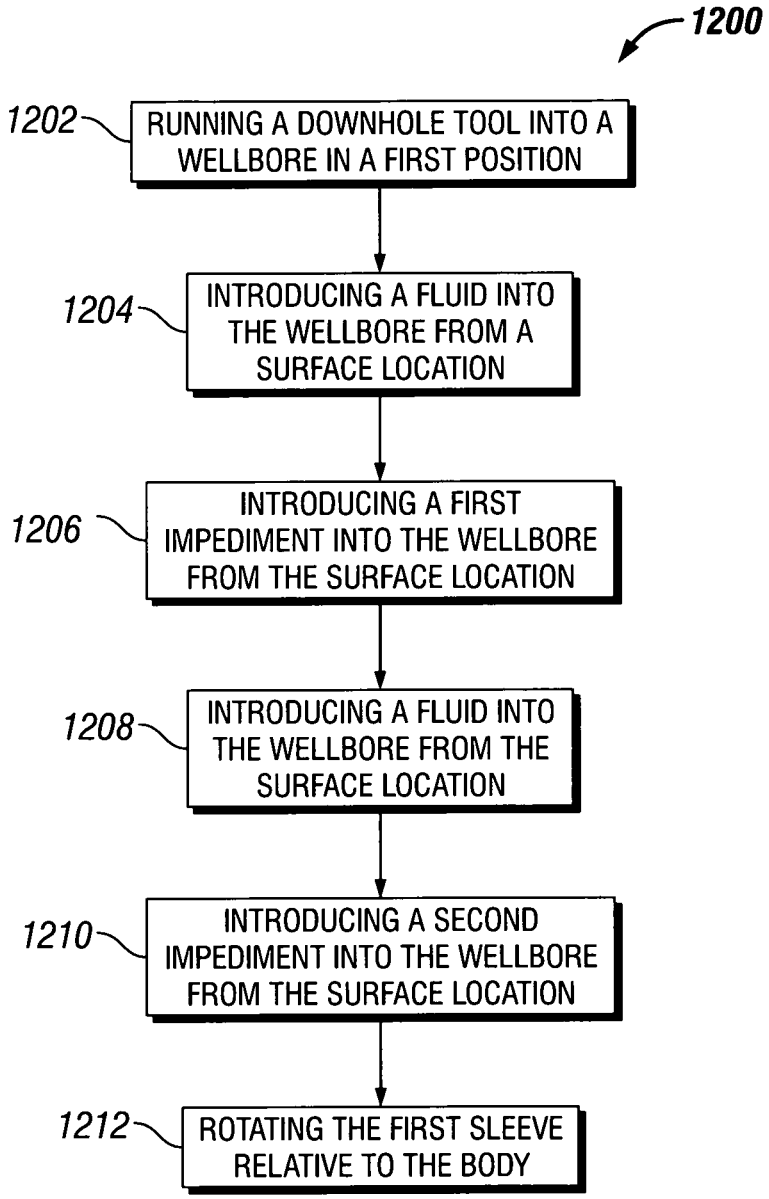
FIG. 12 illustrates a flowchart of a method for cementing a portion of a wellbore, according to an embodiment.

FIG. 12 illustrates a flowchart of a method 1200 for cementing a portion of a wellbore, according to an embodiment. The method 1200 may include running the downhole tool 100 into the wellbore on a wireline, a coiled tubing, or the like, as at 1202. The downhole tool 100 may be run into the wellbore in the first, run-in configuration, as shown in FIG. 2. When the downhole tool 100 reaches the desired position in the wellbore, a first fluid may be introduced into the wellbore from a surface location, as at 1204. A pump at a surface location may increase a pressure of the first fluid causing the first fluid to flow through the bore 112 of the downhole tool 100. The fluid may be a cement slurry, a gravel slurry, a proppant, a chemical treatment, or the like. For example, the fluid may be a cement slurry that flows through the bore 112 and out the lower end of the downhole tool 100 into an annulus formed between a casing and the wellbore wall. The casing may be positioned radially-outward from the downhole tool 100. Accordingly, in such an embodiment, the downhole tool 100 may be configured as a cementing tool (e.g., a stage cementing collar).

A first impediment 180 may then be introduced into the wellbore from the surface location, as at 1206. The first impediment 180 may be a ball, a dart, a plug, or any other obturating member of any shape, size, or configuration. The pump may increase a pressure of a second fluid flowing into the wellbore from the surface location causing the first impediment 180 flow into the bore 112 of the downhole tool 100 and come to rest in the seat 144 of the second sleeve 140. The second fluid may be the same as the first fluid, or the second fluid may be water, a brine, a drilling fluid or "mud," or the like. The first impediment 180 may obstruct the bore 112 (i.e., prevent fluid flow therethrough) when the first impediment 180 is in the seat 144 of the second sleeve 140. With the bore 112 obstructed, the pump may cause the pressure of the second fluid upstream from the first impediment 180 to increase until the shear mechanisms 148 coupling the second sleeve 140 in place break. Once the shear mechanisms 148 break, the downhole tool 100 may be actuated into the second, open position, as shown in FIG. 4.

A third fluid may be introduced into the wellbore from the surface location, as at 1208. The third fluid may be the same as the first fluid or the second fluid. For example, the third fluid may be a cement slurry. The pump at a surface location may increase a pressure of the third fluid causing the third fluid to flow into the bore 112 of the downhole tool 100. As the bore 112 may be obstructed by the first impediment 180, the third fluid may flow through the openings 124 in the first sleeve 120 and the openings 114 in the body 110 to the exterior of the body 110. The third fluid may then flow into the annulus between the casing and the wellbore wall at a different location than the first fluid.

A second impediment 182 may be introduced into the wellbore from the surface location, as at 1210. The second impediment 182 may be a ball, a dart, a plug, or any other obturating member of any shape, size, or configuration. The pump may increase a pressure of a fourth fluid flowing into the wellbore from the surface location causing the second impediment 182 flow into the bore 112 of the downhole tool 100 and come to rest in the seat 164 of the third sleeve 160. The fourth fluid may be the same as the second fluid or the third fluid.

The second impediment 182 may prevent fluid from flowing therepast when the second impediment 182 is in the seat 164 of the third sleeve 160. As such, the pump may cause the pressure of the fourth fluid upstream from the second impediment 182 to increase until the shear mechanisms 134 coupling the third sleeve 160 in place break. Once the shear mechanisms 134 break, the downhole tool 100 may be actuated into the third, closed configuration, as shown in FIG. 5 or FIG. 10.

In an embodiment, the method 1200 may optionally include rotating the first sleeve 120 relative to the body 110 during a drill-out operation, as at 1212. For example, the second impediment 182 may shift the first sleeve 120 axially toward the pin sub 110-2. However, the teeth 180A, 180B of the first sleeve 120 may be angularly offset from the teeth 182A, 182B of the pin sub 110-2, and thus the first sleeve 120 may initially be rotatable relative to the body 110 (including the pin sub 110-2). When the first sleeve 120 is rotated, the teeth 180A, 180B thereof may eventually engage or mesh with the teeth 182A, 182B, producing interference therebetween that may prevent relative rotation between the first sleeve 120 and the body 110, thereby facilitating drill-out operations. In some situations, such rotation may not occur, as the teeth 180A, 180B, 182A, 182B may initially be angularly aligned. Further, such rotation may be prevented by other anti-rotation features, such as by an annular, tapered engaging surface of the first sleeve 120 engaging a similar surface of the pin sub 110-2. A variety of other friction-generating, anti-rotation devices may also or instead be employed.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a body having a bore axially therethrough and an opening radially therethrough, wherein the body comprises a sub having a plurality of tapered, axially-extending teeth;

a first sleeve positioned at least partially in the bore of the body, wherein the first sleeve has an opening radially therethrough that is aligned with the opening of the body when the downhole tool is in a first configuration, wherein an inner surface of the first sleeve defines a first seat, and wherein the first sleeve comprises a plurality of tapered, axially-extending teeth; and a second sleeve positioned at least partially in the first sleeve, wherein the second sleeve is axially aligned with the opening of the first sleeve and prevents fluid flow therethrough when the downhole tool is in the first configuration, and wherein the second sleeve is configured to move axially and engage the first seat of the first sleeve when the downhole tool is in a second configuration, so as to resist relative rotation between the first and second sleeves, wherein the teeth of the sub are sized to be received circumferentially between the teeth of the first sleeve when the downhole tools is in a third configuration, such that the teeth of the sub are circumferentially engageable with the teeth of the first sleeve, wherein the teeth of the sub are also sized to axially overlap the teeth of the first sleeve, such that the teeth of the sub are radially engageable with the teeth of the first sleeve, and wherein the first sleeve and the body are prevented from relative rotation when the downhole tool is in the third configuration by either radial or circumferential engagement between the teeth of the sub and the teeth of the first sleeve.

2. The downhole tool of claim 1, wherein the second sleeve includes a tapered outer surface that is configured to engage the first seat of the first sleeve when the downhole tool is in the second configuration, and wherein an engagement between the tapered outer surface of the second sleeve and the first seat of the first sleeve resists relative rotation between the first and second sleeves.

3. The downhole tool of claim 1, wherein the second sleeve is axially-offset from the opening in the first sleeve when the downhole tool is in the second configuration such that a path of fluid communication exists from the bore, through the opening of the first sleeve, and through the opening of the body, to an exterior of the body.

4. The downhole tool of claim 3, wherein the opening in the first sleeve is offset from the opening in the body when the downhole tool is in the third configuration such that the first sleeve prevents fluid flow through the opening in the body.

5. The downhole tool of claim 4, further comprising a third sleeve positioned in the body, wherein a tapered outer surface of the third sleeve is configured to be received in a second seat of the first sleeve when the downhole tool is in the third configuration, the second seat of the first sleeve being axially offset from the first seat of the first sleeve.

6. The downhole tool of claim 5, wherein an engagement between the tapered outer surface of the third sleeve and the second seat of the first sleeve reduces or prevents relative rotation between the first and third sleeves.

7. The downhole tool of claim 5, further comprising a shear mechanism that couples the first sleeve to the body and couples the third sleeve to the first sleeve, wherein the shear mechanism is configured to break when exposed to a predetermined axial force, thereby allowing the downhole tool to transition from the second configuration to the third configuration.

8. The downhole tool of claim 5, further comprising one or more lock ring segments positioned at least partially within the first sleeve, wherein the one or more lock ring segments are axially-offset from a recess in an outer surface of the third sleeve when the downhole tool is in the first configuration, the second configuration, or both, and wherein the one or more lock ring segments are positioned at least partially within the recess of the third sleeve when the downhole tool is in the third configuration.

9. The downhole tool of claim 1, wherein the first sleeve comprises a guide assembly configured to maintain an impediment received in the first seat of the first sleeve in substantial alignment with a central longitudinal axis through the body.

10. The downhole tool of claim 1, wherein the first sleeve comprises a radially-inwardly extending portion providing the first seat, the radially-inwardly extending portion being separately-formed from a remainder of the first sleeve.

11. A downhole tool, comprising:

a body having a bore axially therethrough and an opening radially therethrough;

a first sleeve positioned at least partially in the bore of the body, wherein the first sleeve has an opening radially therethrough that is aligned with the opening of the body when the downhole tool is in a first configuration, and wherein an inner surface of the first sleeve defines a first seat; and a second sleeve positioned at least partially in the first sleeve, wherein the second sleeve is axially aligned with the opening of the first sleeve and prevents fluid flow therethrough when the downhole tool is in the first configuration, wherein the second sleeve is configured to move axially and engage the first seat of the first sleeve when the downhole tool is in a second configuration, so as to resist relative rotation between the first and second sleeves, wherein the first sleeve comprises a guide assembly configured to maintain an impediment received in the first seat of the first sleeve in substantial alignment with a central longitudinal axis through the body, and wherein the guide assembly comprises a plurality of radial protrusions that are circumferentially-offset from one another.

12. A multi-stage cementing tool, comprising:

a body comprising an axially-extending bore therethrough and a radially-extending opening in communication with the bore;

a first sleeve positioned in the bore of the body, wherein the first sleeve has a radially-extending opening that is aligned with the opening in the body when the cementing tool is in a first configuration, wherein an inner surface of the first sleeve forms first and second seats that are axially-offset from one another;

a second sleeve positioned at least partially in the first sleeve and defining a seat, wherein the second sleeve is axially aligned with the opening in the first sleeve and prevents fluid flow therethrough when the cementing tool is in the first configuration, wherein the second sleeve is axially-offset from the opening in the first sleeve when the tool is in a second configuration such that a path of fluid communication exists from the bore, through the openings in the first sleeve and the body, to an exterior of the body;

a third sleeve positioned in the first sleeve and axially-offset from the second sleeve, wherein the third sleeve is configured to engage the second seat of the first sleeve when the cementing tool is in a third configuration; and a guide assembly configured to maintain an impediment received in the seat of the second sleeve in substantial alignment with a central longitudinal axis through the body, wherein the guide assembly comprises a plurality of radial protrusions that are circumferentially-offset from one another.

13. The cementing tool of claim 12, wherein, when the cementing tool is moved to the third configuration, the first sleeve moves axially into engagement with a sub of the body, such that a friction force between the first sleeve and the sub resists relative rotation therebetween.

14. A method for cementing a portion of a wellbore, comprising:

running a downhole tool into the wellbore in a first configuration, wherein the downhole tool comprises:

a body having a bore axially therethrough and an opening radially therethrough, wherein the body comprises a sub having a plurality of tapered, axially-extending teeth;

a first sleeve positioned at least partially in the bore of the body, wherein the first sleeve has an opening radially therethrough that is aligned with the opening of the body when the downhole tool is in the first configuration, wherein an inner surface of the first sleeve defines a first seat, and wherein the first sleeve comprises a plurality of tapered, axially-extending teeth; and a second sleeve positioned at least partially in the first sleeve, wherein the second sleeve is axially aligned with the opening of the first sleeve and prevents fluid flow therethrough when the downhole tool is in the first configuration, and wherein the second sleeve is configured to move axially and engage the first seat of the first sleeve when the downhole tool is in a second configuration, so as to resist relative rotation between the first and second sleeves, wherein the teeth of the sub are sized to be received circumferentially between the teeth of the first sleeve when the downhole tools is in a third configuration, such that the teeth of the sub are circumferentially engageable with the teeth of the first sleeve, wherein the teeth of the sub are also sized to axially overlap the teeth of the first sleeve, such that the teeth of the sub are radially engageable with the teeth of the first sleeve, and wherein the first sleeve and the body are prevented from relative rotation when the downhole tool is in the third configuration by either radial or circumferential engagement between the teeth of the sub and the teeth of the first sleeve; and pumping a first fluid into the wellbore from a surface location, wherein at least a portion of the first fluid flows through the bore in the body and out a lower end of the body.

15. The method of claim 14, further comprising introducing a first impediment into the wellbore, wherein, at least partially in response to the first impediment being received in the seat of the second sleeve, the second sleeve moves until a tapered outer surface of the second sleeve is received in the first seat of the first sleeve, thereby transitioning the downhole tool into the second configuration, and wherein the second sleeve is axially-offset from the opening in the first sleeve when the downhole tool is in the second configuration such that a path of fluid communication exists from the bore, through the openings in the first sleeve and the body, to an exterior of the body.

16. The method of claim 15, further comprising pumping a second fluid into the wellbore from the surface location, wherein at least a portion of the second fluid flows from the bore in the body, through the openings in the first sleeve and the body, and to the exterior of the body.

17. The method of claim 16, wherein the downhole tool further comprises a third sleeve disposed in the bore of the body, and the first sleeve comprises a second seat that is axially separated from the first seat thereof, the method further comprising introducing a second impediment into the wellbore, wherein, at least partially in response to the second impediment being received in a seat of the third sleeve, the third sleeve moves until a tapered outer surface of the third sleeve is received in the second seat of the first sleeve, thereby transitioning the downhole tool into a third configuration.

18. The method of claim 17, wherein, at least partially in response to the second impediment being received in the seat of the third sleeve, the first sleeve moves until the opening in the first sleeve is axially-offset from the opening in the body, thereby preventing fluid flow through the opening in the body.

19. The method of claim 15, wherein the second sleeve includes a tapered outer surface that is configured to engage the first seat of the first sleeve when the downhole tool is in the second configuration, and wherein an engagement between the tapered outer surface of the second sleeve and the first seat of the first sleeve reduces or prevents relative rotation between the first and second sleeves.

20. The method of claim 14, further comprising rotating the first sleeve relative to the body until the teeth of the first sleeve engage the teeth of the sub of the body.

21. A downhole tool, comprising:

a body having a bore axially therethrough and an opening radially therethrough;

a first sleeve positioned at least partially in the bore of the body, wherein the first sleeve has an opening radially therethrough that is aligned with the opening of the body when the downhole tool is in a first configuration, and wherein an inner surface of the first sleeve defines a first seat; and a second sleeve positioned at least partially in the first sleeve, wherein the second sleeve is axially aligned with the opening of the first sleeve and prevents fluid flow therethrough when the downhole tool is in the first configuration, and wherein the second sleeve is configured to move axially and engage the first seat of the first sleeve when the downhole tool is in a second configuration, so as to resist relative rotation between the first and second sleeves, wherein the second sleeve includes a tapered outer surface, the tapered outer surface and the first sleeve defining a radial gap therebetween when the downhole tool is in the first configuration, and wherein, when the downhole tool is in the second configuration, the first seat is at least partially received into the gap, such that the tapered outer surface of the second sleeve engages the first seat of the sleeve.

* * * * *